US009538809B2

(12) United States Patent
Park

(10) Patent No.: US 9,538,809 B2
(45) Date of Patent: Jan. 10, 2017

(54) SHOCK ABSORBING SHOES WITH IMPROVED ASSEMBLY AND OPERATIONAL PERFORMANCE

(71) Applicant: Cheol Su Park, Seoul (KR)

(72) Inventor: Cheol Su Park, Seoul (KR)

( * ) Notice: Subject to any disclaimer, the term of this patent is extended or adjusted under 35 U.S.C. 154(b) by 0 days.

(21) Appl. No.: 15/222,041

(22) Filed: Jul. 28, 2016

(65) Prior Publication Data

US 2016/0331077 A1 Nov. 17, 2016

Related U.S. Application Data

(63) Continuation-in-part of application No. 13/696,320, filed as application No. PCT/KR2011/003729 on May 20, 2011.

(30) Foreign Application Priority Data

May 27, 2010 (KR) ..... 10-2010-0049597

(51) Int. Cl.
*A43B 1/00* (2006.01)
*A43B 7/14* (2006.01)
*A43B 13/18* (2006.01)

(52) U.S. Cl.
CPC ..... *A43B 7/144* (2013.01); *A43B 13/182* (2013.01)

(58) Field of Classification Search
CPC ..... A43B 7/144; A43B 13/141; A43B 13/181; A43B 13/182; A43B 13/183
USPC ..... 36/102
See application file for complete search history.

(56) References Cited

U.S. PATENT DOCUMENTS 1,088,328 A * 2/1914 Cucinotta ..... A43B 13/182 36/28
3,251,145 A * 5/1966 Mack ..... A43B 13/182 36/28
3,728,809 A * 4/1973 Mulich ..... F41C 9/04 42/1.16

(Continued)

FOREIGN PATENT DOCUMENTS

JP 08107802 4/1996
JP 08107802 A * 4/1996

(Continued)

OTHER PUBLICATIONS

JPO Japanese to English Machine translation of Yuu, Shinhyon et al. Abstract of J.P. 1996-08107802, translated Sep. 25, 2012.*

(Continued)

*Primary Examiner* — Richale Quinn
*Assistant Examiner* — Anne Kozak
(74) *Attorney, Agent, or Firm* — Cantor Colburn LLP

(57) ABSTRACT

A shock absorbing shoe with improved assembly and operational performance is provided. The shock absorbing shoe includes: an outsole; an upper sole arranged on the outsole and having a guide portion; a support unit including: a first support body connected to the outsole; and a second support body connected to the upper sole and having a guide part corresponding to the guide portion; an elastic member arranged between the first and second support bodies of the support unit; and a supporting member connected to the first and second support bodies of the support unit, the supporting member being movable upward and downward along the guide portion and the guide part of the second support body.

3 Claims, 7 Drawing Sheets

(56) References Cited

U.S. PATENT DOCUMENTS 3,754,418 A * 8/1973 Miller ..... E05B 71/00 70/18
3,764,154 A * 10/1973 Witting ..... A63C 5/12 280/618
4,063,830 A * 12/1977 Ban ..... E04H 15/60 135/114
4,196,903 A * 4/1980 Illustrato ..... A43B 13/182 36/7.8
4,322,893 A * 4/1982 Halvorsen ..... A43B 17/06 36/28
4,364,186 A * 12/1982 Fukuoka ..... A43B 13/18 36/29
RE31,173 E * 3/1983 Daswick ..... A43B 5/06 36/103
4,457,084 A * 7/1984 Horibata ..... A43B 5/12 36/28
4,567,907 A * 2/1986 Dubinsky ..... A45B 23/00 135/20.3
5,235,761 A * 8/1993 Chang ..... A43B 1/0072 36/137
5,343,637 A * 9/1994 Schindler ..... A43B 13/182 36/27
5,384,977 A * 1/1995 Chee ..... A43B 1/0009 36/28
5,502,901 A * 4/1996 Brown ..... A43B 1/0018 36/27
5,581,910 A * 12/1996 Lewis ..... A43B 21/46 36/36 R
5,621,984 A * 4/1997 Hsieh ..... A43B 13/182 280/11.115
5,651,196 A * 7/1997 Hsieh ..... A43B 13/182 36/27
5,671,552 A * 9/1997 Pettibone ..... A43B 13/182 36/27
5,682,690 A * 11/1997 Chang ..... A43B 7/00 36/11.5
5,832,629 A * 11/1998 Wen ..... A43B 21/30 36/27
6,055,747 A * 5/2000 Lombardino ..... A43B 13/182 36/27
6,282,814 B1 * 9/2001 Krafsur ..... A43B 7/1425 36/27
6,311,413 B1 * 11/2001 Chern ..... A43B 13/182 36/100
6,314,661 B1 * 11/2001 Chern ..... A43B 3/128 36/11.5
6,393,731 B1 * 5/2002 Moua ..... A43B 13/182 36/27
6,457,261 B1 * 10/2002 Crary ..... A43B 13/181 36/114
6,487,796 B1 * 12/2002 Avar ..... A43B 5/00 36/114
D474,582 S * 5/2003 Cooper ..... D2/947
6,562,427 B2 * 5/2003 Hung ..... A43B 13/182 36/28
D476,474 S * 7/2003 McDowell ..... D2/964
6,622,401 B2 * 9/2003 Carroll, III ..... A43B 7/14 36/105
6,631,570 B1 * 10/2003 Walker ..... A43B 3/24 36/100
6,662,472 B1 * 12/2003 Hsu ..... A43B 13/203 36/29
D519,267 S * 4/2006 Hlavacs ..... D2/964
D538,018 S * 3/2007 Hlavacs ..... D2/964
D553,338 S * 10/2007 Holmes ..... D2/964
7,441,347 B2 * 10/2008 LeVert ..... A43B 13/182 36/27
7,600,330 B2 * 10/2009 Chen ..... A43B 13/182 36/27
7,621,057 B1 * 11/2009 Julian ..... A43B 13/182 36/27
7,814,683 B2 * 10/2010 Lee ..... A43B 13/026 36/25 R
8,142,381 B1 * 3/2012 Birnbaum ..... A43B 7/141 128/882
8,272,146 B1 * 9/2012 Jackson, II ..... A43B 3/0078 36/15
8,347,526 B2 * 1/2013 Goldston ..... A43B 3/0031 36/114
8,555,526 B2 * 10/2013 Elnekaveh ..... A43B 1/0054 36/103
8,632,481 B2 * 1/2014 Shi ..... A43B 3/0015 601/78
9,370,221 B1 * 6/2016 Hsu ..... A43B 13/181
9,380,830 B1 * 7/2016 Greenberg ..... A43B 13/181
2002/0073579 A1 * 6/2002 Lombardino ..... A43B 13/182 36/28
2004/0154191 A1 * 8/2004 Park ..... A43B 13/182 36/28
2005/0198862 A1 * 9/2005 Lo ..... A43B 7/08 36/27
2006/0213082 A1 * 9/2006 Meschan ..... A43B 13/182 36/27
2007/0209233 A1 * 9/2007 Kim ..... A43B 7/082 36/27
2008/0010868 A1 * 1/2008 Tsai ..... A43B 1/0081 36/141
2008/0313928 A1 * 12/2008 Adams ..... A43B 5/1633 36/103
2009/0282697 A1 * 11/2009 Lee ..... A43B 13/182 36/27
2010/0058616 A1 * 3/2010 Ryoo ..... A43B 13/187 36/102
2010/0095553 A1 * 4/2010 Elnekaveh ..... A43B 1/0054 36/102
2010/0139123 A1 * 6/2010 Alan ..... A43B 3/24 36/100
2010/0139127 A1 * 6/2010 Huang ..... A43B 1/0018 36/3 B
2011/0138650 A1 * 6/2011 Gershon ..... A43B 3/108 36/11.5
2011/0225842 A1 * 9/2011 Lu ..... A43B 21/26 36/27
2012/0137541 A1 * 6/2012 Yeo ..... A43B 13/182 36/27

FOREIGN PATENT DOCUMENTS

KR 200208464 10/2000
WO 2004068987 8/2004
WO 2010052592 5/2010

OTHER PUBLICATIONS

International Search Report—PCT/KR2011/003729 dated Feb. 23, 2012.

* cited by examiner

[A]

[B]

SHOCK ABSORBING SHOES WITH IMPROVED ASSEMBLY AND OPERATIONAL PERFORMANCE

CROSS-REFERENCE TO RELATED APPLICATIONS

This application is a continuation-in-part of U.S. Ser. No. 13/696,320, filed on Nov. 6, 2012, which is a national entry of PCT Application No. PCT/KR2011/003729 filed on May 20, 2011, which claims priority to and the benefit of Korean Application No. 10-2010-0049597 filed on May 27, 2010, in the Korean Patent Office, the entire contents of which are incorporated herein by reference.

TECHNICAL FIELD

The present invention relates to a shock absorbing shoe with improved assembly and operational performance, which is provided with a supporting member capable of preventing the removal or separation of an elastic member, thereby improving durability of the shock absorbing shoe, and in which an upper sole and a second support body of a support unit are provided with a guide portion and a guide part, respectively, so that when the elastic member is compressed and reverts back to its original shape after being compressed and the supporting member moves upward and downward during walking, it is possible to guide the movement of the supporting member, thereby realizing improved operational reliability of both the elastic member and the supporting member, and in which the elastic member and the support unit that supports the upper and lower ends of the elastic member can be easily and simply assembled thanks to the supporting member so that the shock absorbing shoe of the present invention can be easily assembled and can reduce the shoe assembling time in comparison with conventional shock absorbing shoes, thereby increasing the productivity, and of which respective elements can be easily disassembled by disassembling only the supporting member so that the shoe of the present invention can be easily repaired and maintained, thereby improving work efficiency.

BACKGROUND ART

Generally, shoes function to protect the feet of a user and to absorb shocks, thereby providing the feet with relief from fatigue. In recent years, a variety of functional shoes that have such foot protecting and shock absorbing functions have been proposed.

Particularly, in shock absorbing shoes that have the specific function of absorbing shock, coil springs are assembled in various manners in an effort to realize easy repair and easy maintenance of the coil springs that are elastically deformed in order to absorb shocks.

In the prior art, to assemble a coil spring in a shock absorbing shoe, the coil spring may be embedded in the heel of the shoe or may be assembled in the shoe using a support unit and a bolt or may be assembled to the support unit by inserting the coil spring into the support unit.

However, the above-mentioned conventional manners for assembling the coil springs in the shock absorbing shoes cannot reliably support the coil springs.

Further, when the coil springs of the conventional shock absorbing shoes are loaded and compressed, the turns of each coil spring may come into contact with each other so that the coil springs may be broken by shocks.

The broken coil springs of the shoes must be repaired or replaced by new springs, thereby imposing a financial burden on users.

Further, due to the above-mentioned coil springs, the conventional shock absorbing shoes cannot realize reliability and cannot appeal to consumers.

SUMMARY OF THE INVENTION

Accordingly, the present invention has been made keeping in mind the above problems occurring in the related art, and is intended to provide a shock absorbing shoe with improved assembly and operational performance, in which a supporting member is provided to prevent removal or separation of an elastic member, thereby improving durability of the shock absorbing shoe, a guide portion and a guide part are provided in an upper sole and a second support body of a support unit, respectively, so that when the elastic member is compressed and reverts back to its original shape after being compressed and the supporting member moves upward and downward during walking, it is possible to guide the movement of the supporting member, thereby realizing improved operational reliability of both the elastic member and the supporting member, the elastic member and the support unit that supports the upper and lower ends of the elastic member can be easily and simply assembled by the supporting member so that the shock absorbing shoe of the present invention can be easily assembled and can reduce the shoe assembly time in comparison with conventional shock absorbing shoes, thereby increasing productivity, and respective elements can be easily disassembled by disassembling only the supporting member so that the shoe of the present invention can be easily repaired and maintained, thereby improving work efficiency.

Further, the present invention provides a shock absorbing shoe with improved assembly and operational performance, in which a holding means is provided both in a first holding body that is combined with the first support body of the support unit and in the lower end of the supporting member so that the present invention can prevent the supporting member from being released or loosened by vibrations or shocks that are applied to the shoe while walking, thereby improving reliability of the product, and respective elements can be easily and simply assembled and disassembled by the holding means so that productivity and work efficiency of the present invention are improved during a process of assembling or disassembling the elements.

Further, the present invention provides a shock absorbing shoe with improved assembly and operational performance, in which a stopping means is provided both in the second holding body that is combined with the second support body of the support unit and in the upper end of the supporting member so that the present invention can prevent the second holding body and the supporting member from being unexpectedly separated from each other during upward and downward movement of the supporting member, thereby allowing a user to safely use the shoe.

In an aspect, the present invention provides a shock absorbing shoe with improved assembly and operational performance, including: an outsole; an upper sole arranged on the outsole and having a guide portion; a support unit including: a first support body connected to the outsole; and a second support body connected to the upper sole and having a guide part corresponding to the guide portion; an elastic member arranged between the first and second support bodies of the support unit; and a supporting member connected to the first and second support bodies of the support unit, the supporting member being movable upward and downward along the guide portion and the guide part of the second support body.

In the present invention, the first and second support bodies of the support unit may include first and second holding bodies that are connected to the elastic member, and the first holding body and the supporting member may be provided with a holding means.

Further, in the present invention, the holding means may include: a seat groove formed in a lower surface of the first holding body; an insert hole formed in a lower end of the supporting member so as to correspond to the seat groove; and a locking pin inserted through the insert hole and seated in the seat groove.

Further, in the present invention, the second holding body may be provided with a corresponding guide part that corresponds to the guide part of the second support body, and the corresponding guide part of the second holding body and the supporting member may be provided with a stopping means.

As described above, the shock absorbing shoe with improved assembly and operational performance according to the present invention is advantageous in that it has a supporting member capable of preventing removal or separation of the elastic member so that the present invention can realize a shock absorbing shoe that has improved durability.

Further, the guide portion and the guide part are provided in the upper sole and the second support body of the support unit, respectively, so that when the elastic member is compressed and reverts back to its original shape after being compressed and the supporting member moves upward and downward during walking, the present invention can guide the movement of the supporting member, thereby realizing improved operational reliability of both the elastic member and the supporting member.

Further, the elastic member and the support unit that supports the upper and lower ends of the elastic member can be easily and simply assembled by the supporting member so that the shoe can be easily assembled and can reduce the shoe assembly time in comparison with conventional shock absorbing shoes, thereby increasing productivity.

Further, respective elements of the present invention can be easily disassembled by disassembling only the supporting member, thereby easily repairing and maintaining the shoe and, accordingly, improving work efficiency.

Further, in the present invention, the holding means is provided both in the first holding body that is combined with the first support body of the support unit and in the lower end of the supporting member, thereby preventing the supporting member from being released or loosened by vibrations or shocks that are applied to the shoe while walking and, accordingly, improving reliability of the product.

Further, the respective elements of the present invention can be easily and simply assembled and disassembled by the holding means, thereby improving productivity and work efficiency during a process of assembling or disassembling the elements.

Further, in the present invention, the stopping means is provided both in the second holding body that is combined with the second support body of the support unit and in the upper end of the supporting member so that the present invention can prevent the second holding body and the supporting member from being unexpectedly separated from each other during upward and downward movement of the supporting member, thereby allowing a user to safely use the shoe.

DETAILED DESCRIPTION OF THE INVENTION

Herein below, a shock absorbing shoe with improved assembly and operational performance according to the present invention will be described in detail with reference to the accompanying drawings.

Figure 1:
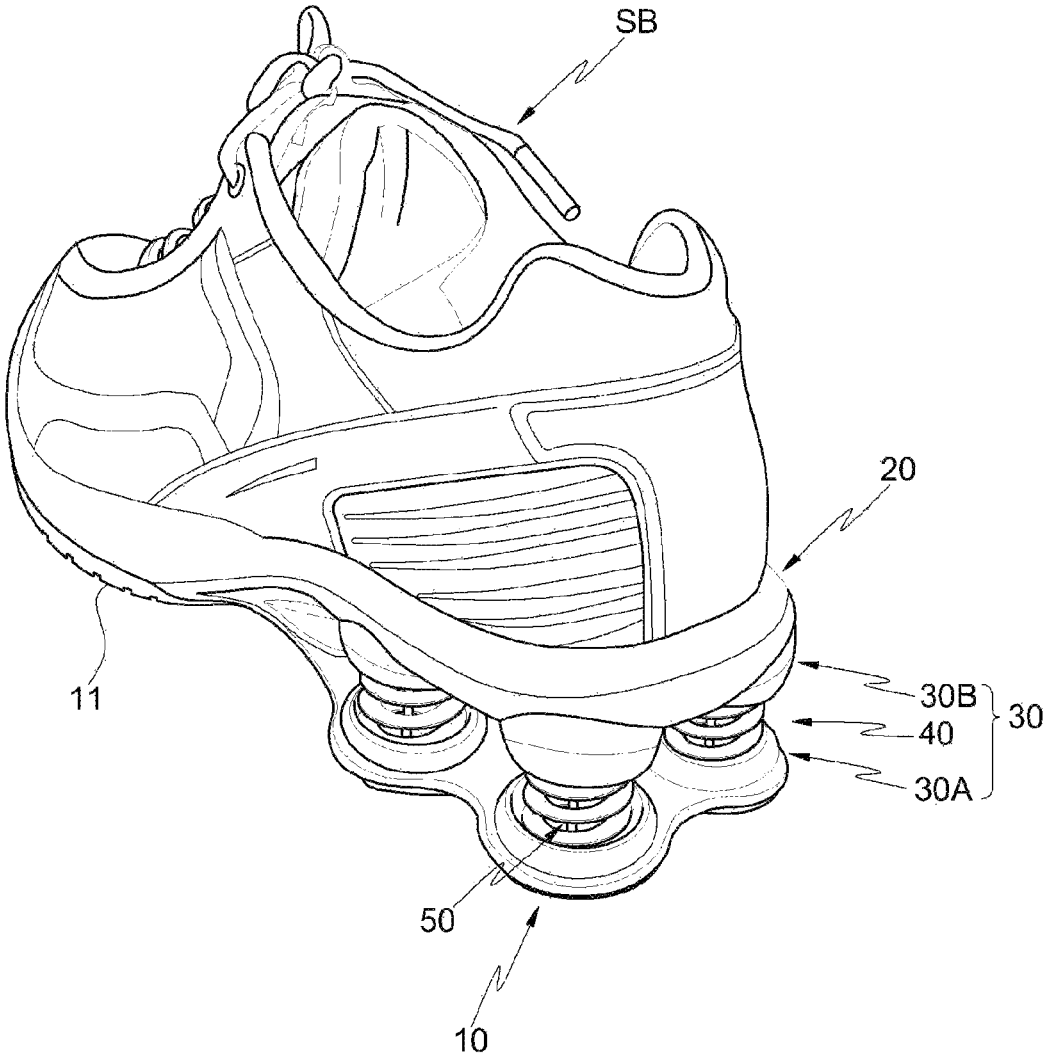
FIG. 1 is a perspective view illustrating a shock absorbing shoe with improved assembly and operational performance according to the present invention.
Figure 2:
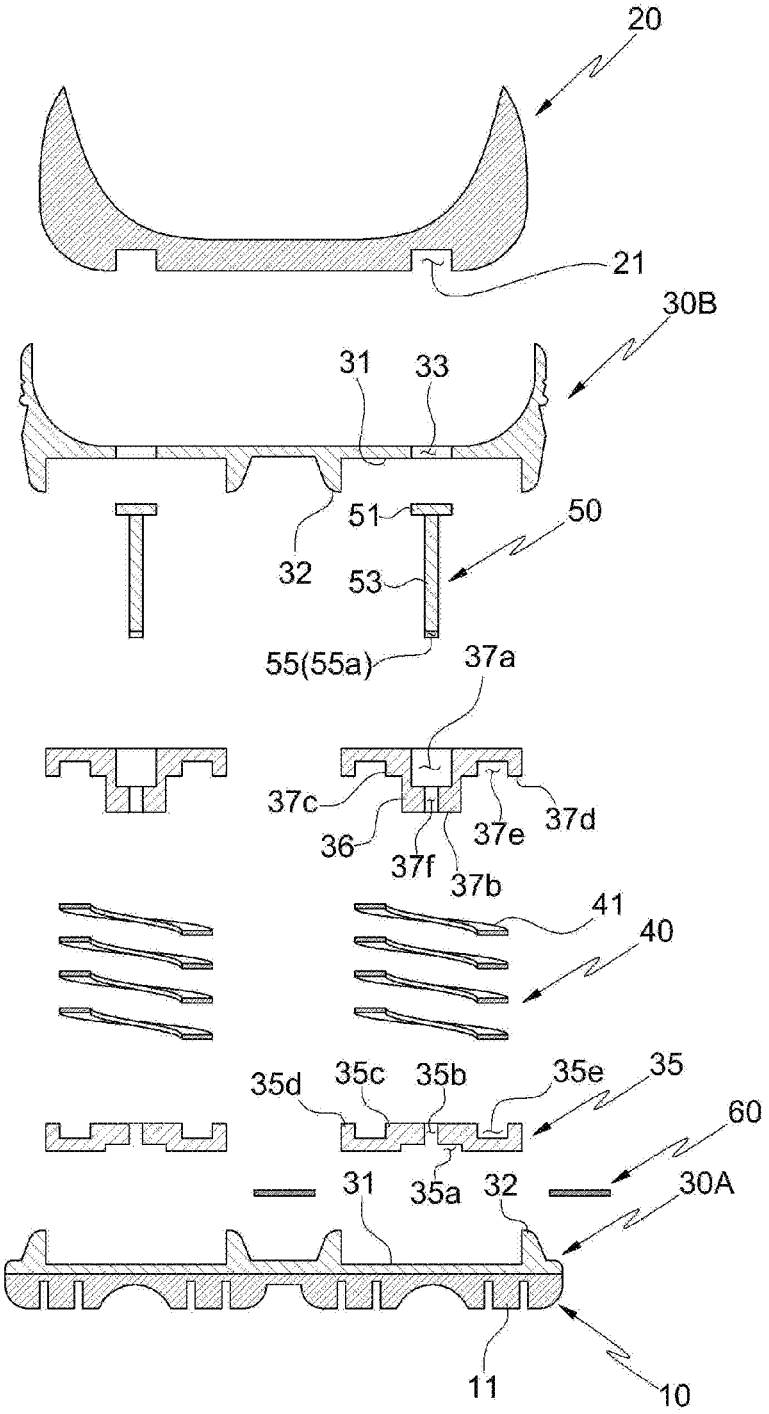
FIG. 2 is an exploded perspective view illustrating the shock absorbing shoe with improved assembly and operational performance according to the present invention.

As shown in FIGS. 1 and 2, the shock absorbing shoe with improved assembly and operational performance according to the present invention includes: an outsole 10; an upper sole 20 which is arranged on top of the outsole 10 and has a guide portion 21; a support unit 30 which includes a first support body 30A that is connected to the outsole 10, and a second support body 30B that is connected to the upper sole 20 and has a guide part 33 corresponding to the guide portion 21; an elastic member 40 which is arranged between the first and second support bodies 30A and 30B of the support unit 30; and a supporting member 50 which is connected to the first and second support bodies 30A and 30B of the support unit 30 and moves upward and downward through both the guide portion 21 and the guide part 33 of the second support body 30B.

Figure 3:
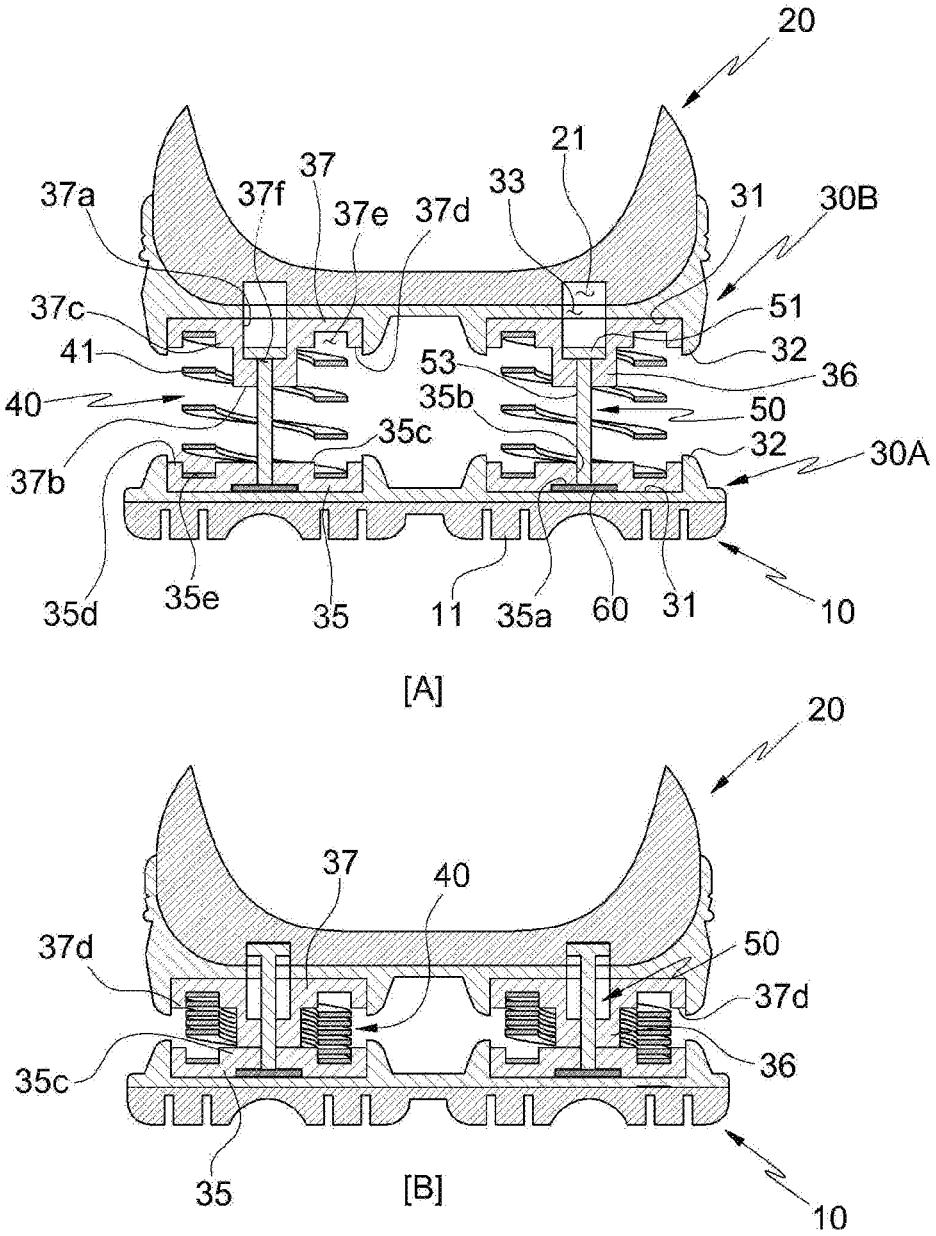
FIG. 3 is sectional views illustrating operations of the shock absorbing shoe according to the present invention.
Figure 4:
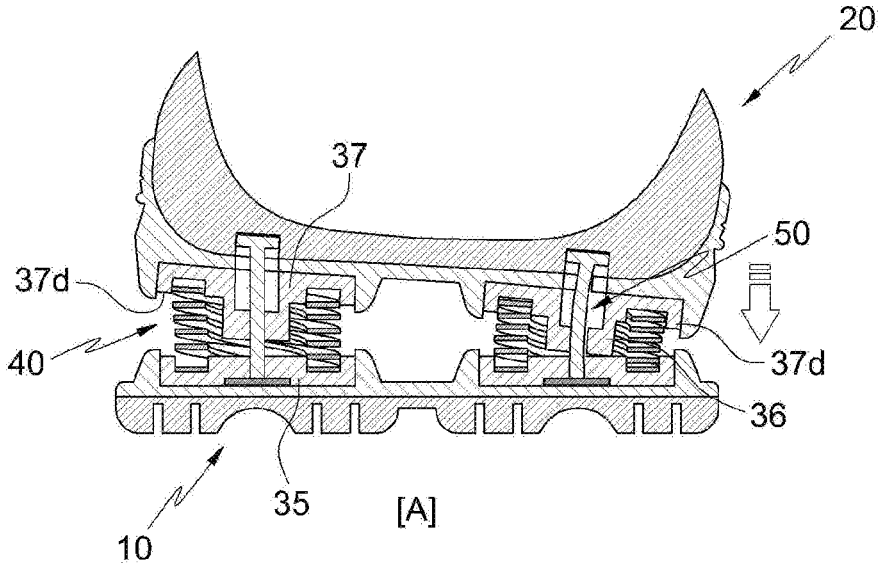
FIG. 4 is sectional views showing operations of the shock absorbing shoe according to the present invention.
Figure 4:
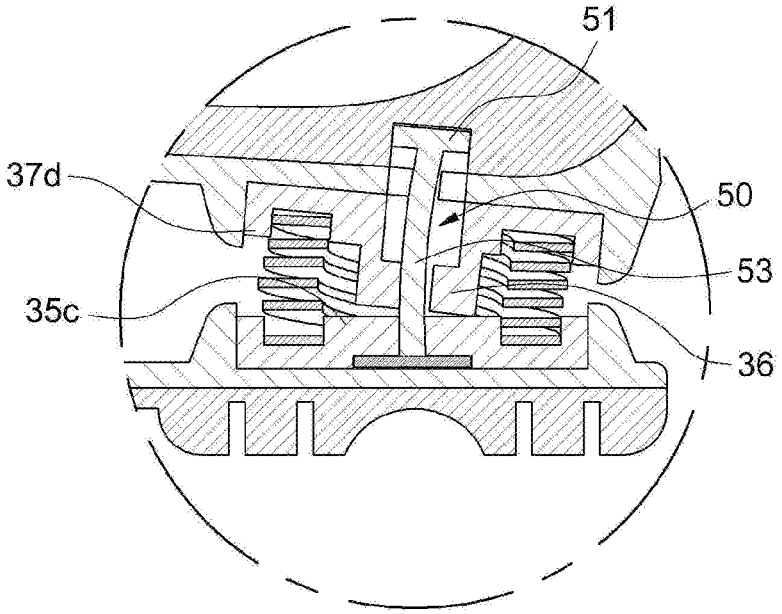

As shown in FIGS. 2 to 4, in the shock absorbing shoe with improved assembly performance and improved operational performance according to the present invention, the outsole 10 is configured as follows.

The upper surface of the outsole 10 is firmly bonded to the lower surface of the first support body 30A of the support unit 30 using a bonding agent or a strong adhesive. This outsole 10 makes direct contact with the ground surface.

Here, the lower surface of the outsole 10 is a part that comes into direct contact with the ground surface so that, in order to absorb shocks and prevent slipping when the lower surface of the outsole is brought into contact with the ground surface. For this reason, it is preferred that the outsole be formed using an elastic material, such as elastomer, polyurethane or rubber.

Further, in order to improve the shock absorbing and slip prevention function, the outsole 10 is configured as follows using the above-mentioned elastic material.

That is, studs 11 are formed on the lower surface of the outsole in such a way that a plurality of protrusions or a plurality of prominences and depressions are formed on the lower surface of the outsole. Accordingly, the outsole has an improved shock absorbing function and an improved slip preventing function.

Figure 5:
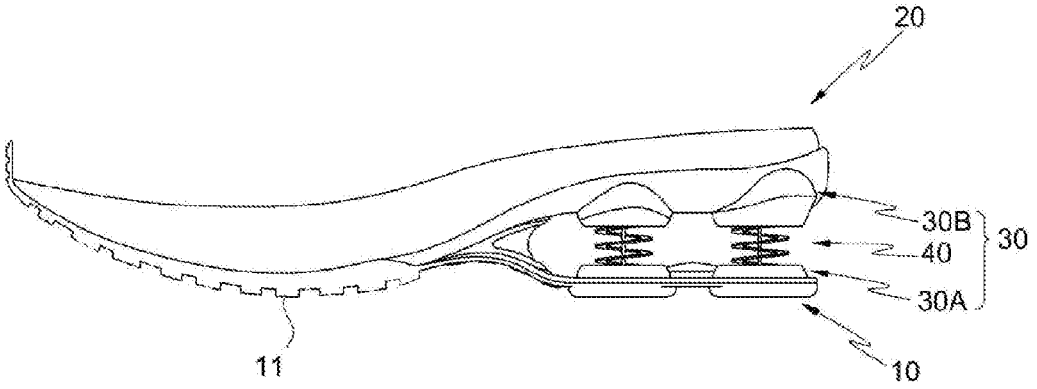
FIG. 5 is a side view illustrating the shock absorbing shoe according to the present invention.
Figure 6:
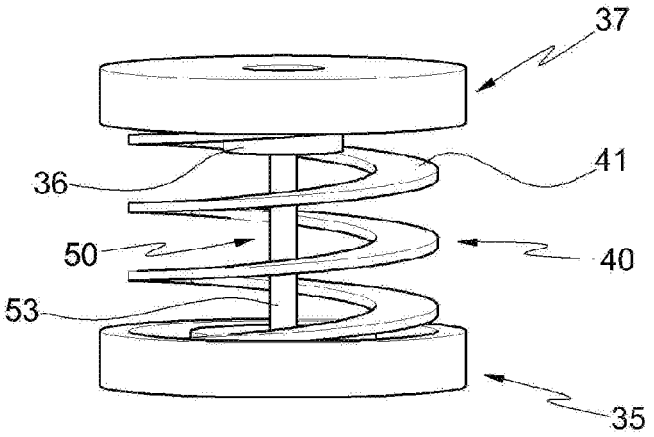
FIG. 6 is a side view illustrating holding bodies, an elastic member and a supporting member of the shock absorbing shoe according to the present invention.
Figure 7:
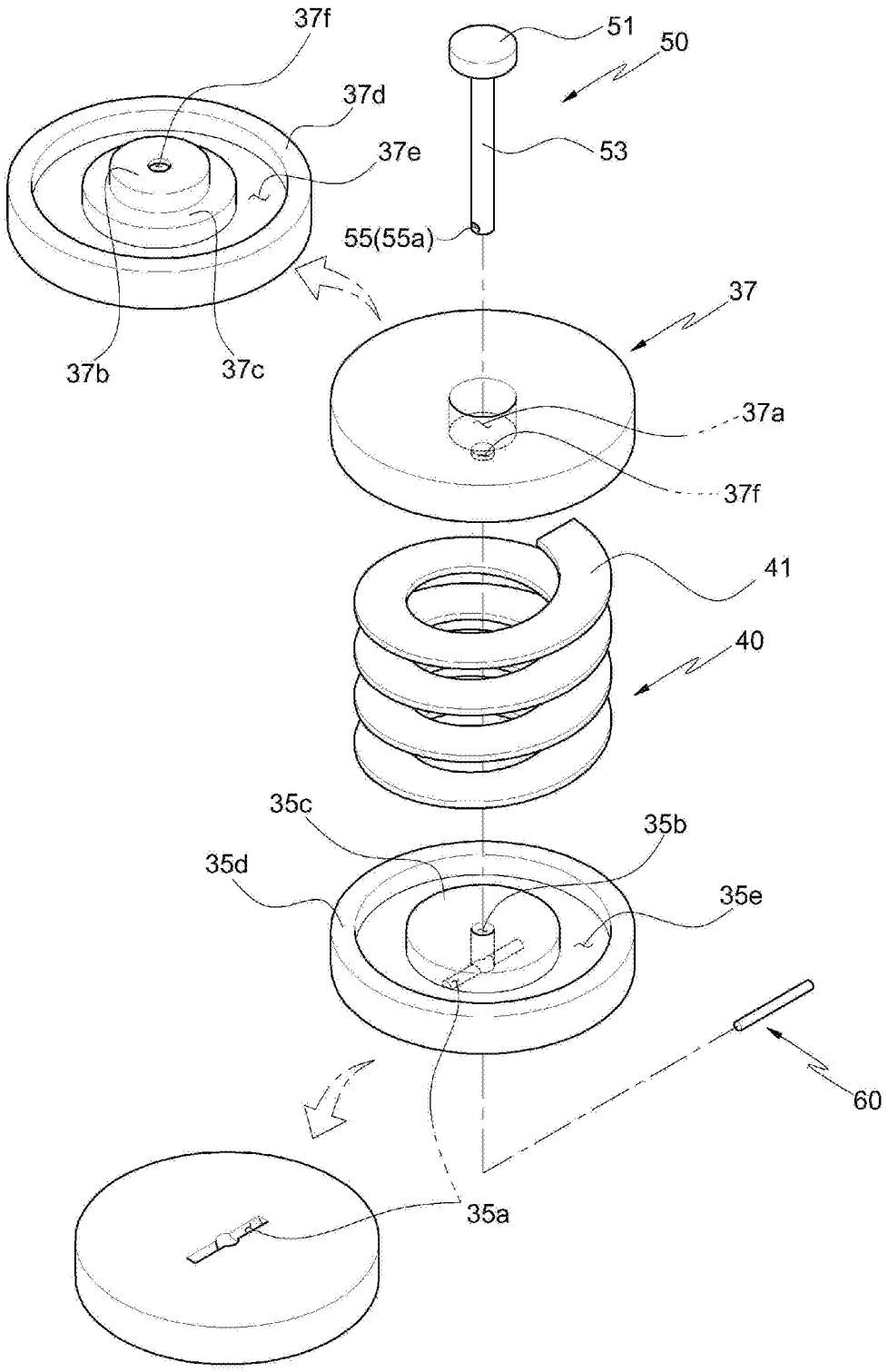
FIG. 7 is an exploded perspective view illustrating a holding means and a stopping means of the shock absorbing shoe according to the present invention.

Further, the outsole 10 has an integrated structure in which the front sole and the heel of the outsole are integrated into a single structure, as shown in FIG. 5.

The above-mentioned integrated structure of the outsole 10 can solve the problem that has been experienced with a separated outsole in which the front sole becomes separated from the heel so that a user may fall over a stone or a protruding object while walking.

Further, a stone or a protruding object may insert itself between the front sole and the heel of the separated outsole so that the stone or the protruding object causes the user discomfort while walking. However, the integrated structure of the outsole 10 of the present invention can solve the above-mentioned problem.

Referring back to FIGS. 2 through 4, in the shock absorbing shoe with improved assembly and operational performance according to the present invention, the upper sole 20 is configured as follows.

The upper sole is arranged on top of the outsole 10. The lower surface of the upper sole is firmly bonded to the upper surface of the second support body 30B of the support unit 30 using a bonding agent or a strong adhesive so that the sole of a user or an insole is laid on the upper surface of the upper sole.

Further, a shoe body SB is connected to the top of the upper sole 20 and covers the instep of the user, thereby safely protecting the instep of the user when the user walks or exercises, as shown in FIG. 1.

In the upper sole 20 of the present invention, four guide portions 21 having a grooved shape are formed at four locations of a heel part at which four elastic members 40 are arranged.

According to one embodiment of the present invention, two guide portions 21 may be arranged with their associated structural elements.

Each of the four guide portions 21 is arranged inside an associated elastic member 40 so that, when the supporting member 50 that is combined with the first and second support bodies 30A and 30B of the support unit 30 moves upward and downward, the guide portion 21 functions to guide the upper portion of the supporting member 50.

In other words, when the user walks and the elastic member 40 is repeatedly compressed and reverts back to its original shape after being compressed, the guide portion 21 can guide the movement of the supporting member 50 that moves upward and downward relative to the elastic member 40, thereby realizing improved operational reliability of the supporting member 50.

As shown in FIGS. 1 through 4, in the shock absorbing shoe with improved assembly and operational performance according to the present invention, the support unit 30 is configured as follows.

The support unit 30 is mounted to the upper surface of the outsole 10 and to the lower surface of the upper sole 20 and is combined with the elastic member 40, thereby supporting the elastic member 40 at a desired location.

The support unit 30 of the present invention includes the first and second support bodies 30A and 30B.

The first support body 30A is held in the upper surface of the outsole 10. The second support body 30B is held in the lower surface of the upper sole 20.

Further, the guide part 33 having a hole shape is formed in the second support body 30B so that the guide part 33 corresponds to the guide portion 21 of the upper sole 20.

When the supporting member 50 moves upward and downward, the guide part 33 guides the movement of the supporting member 50, thereby realizing the improved operational reliability of the supporting member 50.

Further, in each of the first and second support bodies 30A and 30B, the annular protrusions 32 are formed at locations at which the elastic members 40 are arranged. A depressed seat 31 is formed inside each of the annular protrusions 32 so as to fix and hold first and second holding bodies 35 and 37 having a disc shape therein.

Further, in the support unit 30 of the present invention, the first and second holding bodies 35 and 37 having a disc shape are mounted to the depressed seats 31 of the first and second support bodies 30A and 30B by fitting and bonding.

The first holding body 35 is combined with the lower end of the elastic member 40 and the second holding body 37 is combined with the upper end of the elastic member 40.

Respective annular rims 35*d* and 37*d* are formed along the edges of the first and second holding bodies 35 and 37, and respective seat depressions 35*e* and 37*e* are formed inside the rims 35*d* and 37*d*.

Further, fitting protrusions 35*c* and 37*c* are formed in the centers of the respective seat depressions 35*e* and 37*e* so that the elastic member 40 can be held by the first and second holding bodies 35 and 37 as follows.

When the opposite ends of the elastic member 40 are fitted into the respective seat depressions 35*e* and 37*e*, the outer circumferential surfaces of the opposite ends of the elastic member 40 come into contact with the inner circumferential surfaces of the rims 35*d* and 37*d*.

Further, the inner circumferential surfaces of the opposite ends of the elastic member 40 come into contact with the outer circumferential surfaces of the fitting protrusions 35*c* and 37*c*. Accordingly, the upper and lower ends of the elastic member 40 can be firmly held by the rims 35*d* and 37*d*, the seat depressions 35*e* and 37*e*, and the fitting protrusions 35*c* and 37*c* so that it is possible to prevent the elements from being removed or separated from each other.

Here, the elastic member 40 may be combined with the first and second holding bodies 35 and 37 through fitting or bonding.

However, to realize easy assembly of the elements based on the structural characteristics of the first and second holding bodies 35 and 37, it is preferred that the elastic member 40 be fitted into the first and second holding bodies 35 and 37.

Further, as shown in FIGS. 3 and 4, a protruding spacer part 36 is protruded on the lower surface of the fitting protrusion 37*c* of the second holding body 37. More specifically, the protruding spacer 36 is protruded beyond the height of the rim 37*d* toward the fitting protrusion 35*c* of the second holding body 35, but remains spaced apart therefrom so that, when the elastic member 40 is compressed, the lower surface of the protruding spacer part 36 comes into contact with the fitting protrusion 35*c* of the first holding body 35.

As shown in FIG. 3, the protruding spacer part 36 in the above state can space the first and second holding bodies 35 and 37 away from each other by a predetermined gap so that it is possible to prevent the neighboring turns of a coil spring 41 that is used as the elastic member 40 from coming into contact with each other or from striking each other, for example, when the user runs or jumps and thus the coil spring 41 is extremely compressed, thereby preventing the elastic member 40 (the coil spring 41) from being damaged or broken by shocks, as shown in (B) of FIG. 3.

In FIGS. 2, 3, and 4, according to one embodiment of the present invention, the protruding spacer part 36 is formed on the lower surface of the fitting protrusion 37*c* of the second holding body 37.

However, it should be understood that although it is not shown in the accompanying drawings, the protruding spacer part 36 may be formed on the upper surface of the fitting protrusion 35*c* of the first holding body 35 so that, when the elastic member is compressed, the protruding spacer part 36 comes into contact with the lower surface of the fitting protrusion 37*c* of the second holding body 37 and spaces the first and second holding bodies 35 and 37 away from each other by a predetermined gap, thereby performing the same operational function as that described above.

Further, the second holding body 37 has a corresponding guide part 37*a*, which is formed in the second holding body 37 in such a way that the corresponding guide part 37*a* is defined inside the protruding spacer part 36 of the second holding body 37.

In other words, the corresponding guide part 37*a* is formed inside the protruding spacer part 36 so as to correspond to the guide part 33 of the second support body 30B so that, when the supporting member 50 moves upward and downward, the corresponding guide part 37*a* can guide the movement of the supporting member 50, thereby realizing improved operational reliability of the supporting member 50.

Here, the guide portion 21 of the upper sole 20, the guide part 33 of the second support body 30B and the corresponding guide part 37*a* of the second holding body 37 communicate with each other so that the supporting member 50 can move upward and downward thanks to the above-mentioned elements which are all in communication with each other.

In the above state, the guide portion 21, the guide part 33 and the corresponding guide part 37*a* allow the supporting member 50 to reliably move without interfering with the other elements.

As shown in FIGS. 1 through 6, in the shock absorbing shoe with improved assembly and operational performance according to the present invention, the configuration of the elastic member 40 is as follows.

The elastic member is placed between the first and second support bodies 30A and 30B of the support unit 30 so that the elastic element can absorb and attenuate shocks that are applied to the heel of the user when the user walks, thereby relieving the feet of the user from fatigue and allowing the user to walk, run or jump in comfort.

Here, a coil spring 41 is used as the elastic member 40 of the present invention, in which the lower and upper ends of the coil spring 41 are combined with the first and second holding bodies 35 and 37, respectively.

In the above state, the coil spring 41 is firmly held by the inner circumferential surfaces of the rims 35*d* and 37*d* of the respective holding bodies 35 and 37, and by the seat depressions 35*e* and 37*e*, and by the fitting protrusions 35*c* and 37*c*.

Accordingly, when a user wearing the shoes having the coil springs 41 walks, exercises or is working, the coil springs perform their functions as follows.

When a load formed by the weight of the user is applied to the ground surface through the shoes, a reactive shock is applied upward from the ground surface to the user. In the above state, the coil springs 41 elastically absorb and attenuate the shock.

Accordingly, even when the user continuously walks, exercises or is working for a lengthy period of time, the coil springs can efficiently absorb and attenuate the shocks that are applied to the feet and body of the user, thereby relieving the feet and the body from fatigue and realizing the healthful function of the shoes and allowing the user to feel comfortable.

Further, it is preferred that the coil springs 41 have a square cross-section.

When the coil springs 41 are compressed by the load of the user, the coil springs that are arranged in the shoe may strike each other.

Here, when coil springs 41 having a circular cross-section are used, the outer circumferential surfaces of the coil springs 41 may come into contact with each other, so that their striking each other may cause them to easily break.

However, when the coil springs 41 having a square cross-section are used in the shoe and are compressed by the load, the springs 41 come into contact with each other along the flat surfaces thereof, thereby minimizing the breakage of the springs even should the springs strike each other.

As shown in FIGS. 1 through 7, in the shock absorbing shoe with improved assembly and operational performance according to the present invention, the supporting member 50 is configured as follows.

The supporting member is connected to the first and second support bodies 30A and 30B of the support unit 30 at a location between the two support bodies so that, when the elastic member 40 repeats elastic deformation when the user walks, the supporting member can prevent removal or separation of the elastic member 40.

In other words, the supporting member 50 of the present invention is coupled to the first and second holding bodies 35 and 37 that are combined with the first and second support bodies 30A and 30B, respectively.

In the above state, the lower end of the supporting member 50 is combined with the first holding body 35.

The upper end of the supporting member 50 is combined with the second holding body 37 so that the supporting member can repeatedly move upward and downward when the user walks.

Described in detail, the supporting member 50 includes a head 51 that is formed in the upper end of the supporting member, a shank 53 that extends downward from the lower surface of the head 51, and a locking part 55 that is formed in the lower end of the shank 53.

Here, the locking part 55 is connected to the first holding body 35 by a holding means FM.

The head 51 is seated in the corresponding guide part 37*a* of the second holding body 37 so that, when the elastic member 40 performs an elastic action, the head 51 can prevent the removal or separation of the supporting member 50 from the second holding body 37. In the above state, the head 51 cooperates with a stopping means SP.

The construction for combining the supporting member 50 and the first holding body 35 with each other using the holding means FM will be described hereinbelow with reference to FIGS. 2 through 6.

A through hole 35*b* is formed through the center of the first holding body 35.

Further, seat grooves 35*a* are symmetrically formed in the lower surface of the first holding body on opposite sides of the through hole 35*b*.

Further, an insert hole 55*a* is formed in the locking part 55 that is provided in the lower end of the supporting member 50.

Further, a locking pin 60 is provided. To combine the supporting member and the first holding body with each other, the locking pin 60 is inserted into the insert hole 55*a* after the supporting member 50 is inserted into the through hole 35*b*. Thereafter, the locking pin 60 is seated in the seat grooves 35*a*.

When the lower end of the supporting member 50 is combined with the first holding body 35, the holding means FM performs the following function.

The holding means FM can more easily and efficiently combine the supporting member 50 and the first holding body 35 with each other.

Further, the assembled holding means can prevent the supporting member 50 and the first holding body 35 from being released from each other by vibrations or shocks that may be applied both to the supporting member and to the first holding body when a user wearing the shoes walks.

To realize the above-mentioned function of the holding means FM, the locking pin 60 of the holding means FM is seated in the seat grooves 35*a* of the first holding body 35 after the locking pin 60 has been inserted into the insert hole 55*a* of the supporting member 50 so that the locking pin 60 can hold and prevent rotation of the supporting member 50 irrespective of vibrations or shocks that are applied to the supporting member.

Figure 8:
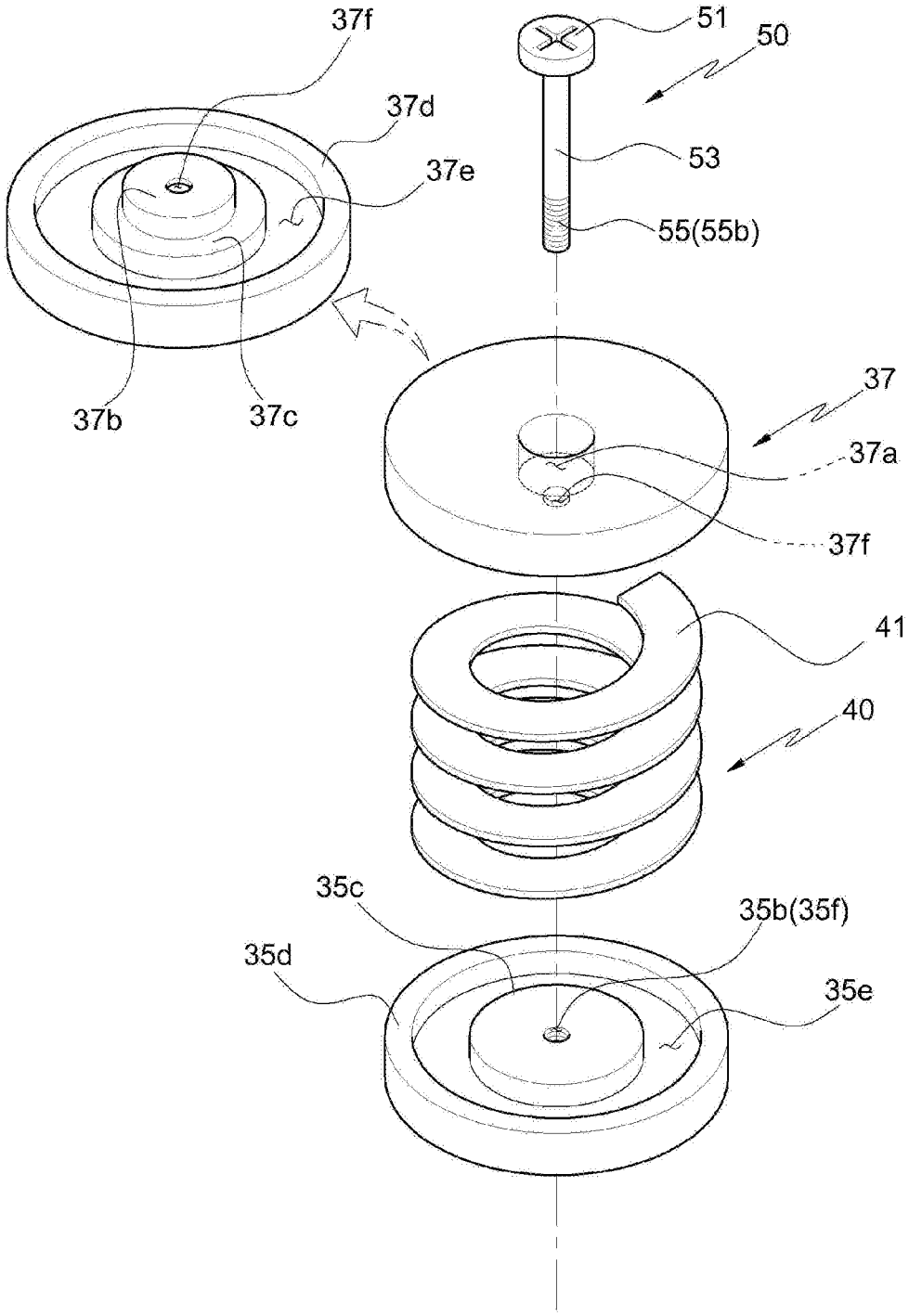
FIG. 8 is an exploded perspective view illustrating a modification of the holding means of the shock absorbing shoe according to the present invention.

FIG. 8 illustrates a modification of the holding means FM.

In the modification, an internal thread 35*f* is formed on the inner circumferential surface of the through hole 35*b* of the first holding body 35, and an external thread 55*b* is formed around the outer circumferential surface of the locking part 55 of the supporting member 50 so that the supporting member 50 can be tightened to the holding body 35 by rotating the supporting member relative to the holding body.

In the above state, it is preferred that the upper surface of the head 51 of the supporting member 50 be recessed to form a straight recess, a cross recess or a combined recess so that the supporting member and the first holding body can be easily assembled and disassembled using a tool.

Hereinbelow, the structure for combining the supporting member 50 with the second holding body 37 using the stopping means SP will be described with reference to FIGS. 2 through 7.

A stopper 37*b* is formed in the lower part of the corresponding guide part 37*a* of the second holding body 37.

That is, the stopper 37*b* is formed on the lower surface of the protruding spacer part 36 of the second holding body 37.

Further, a shank passing hole 37*f* is formed through the center of the protruding spacer part 36. Here, the diameter of the shank passing hole 37*f* is less than inner diameter of the corresponding guide part 37*a* but is greater than that of the shank 53.

The stopper 37*b* is formed in the shape of a step at an area around the shank passing hole 37*f*.

Accordingly, when the shank 53 of the supporting member 50 passes through the shank passing hole 37*f*, the shank 53 can move through the shank passing hole 37*f* when the elastic member 40 is compressed and reverts back to its original shape after having been compressed.

Further, when the elastic member 40 fully extends and completely reverts back to its original shape, the head 51 that is connected to the upper end of the shank 53 of the supporting member 50 can be caught and held by the stopper 37*b*.

Therefore, it is possible to prevent removal or separation of the supporting member 50 from the second holding body 37.

Furthermore, according to one embodiment of the present invention, the shank 53 of the supporting member may be flexible. Therefore, as shown in (A) of FIG. 4, even when the ground surface is uneven or the user loses his or her balance, the shank 53 can bend so that shoes of the invention can absorb shock and impact from the ground in more efficient and effective manner. (B) in FIG. 4 more clearly illustrates the above operation of the flexible shank 53 in cooperation with the protruding spacer part 36.

More specifically, when the user runs or jumps on an uneven ground, or the user loses his or her balance, the shoes according the present invention can absorb shock from the ground while preventing the elastic member 40 (the coil spring 41) from being damaged or broken, as illustrated in (B) of FIG. 4.

Although the shock absorbing shoe with improved assembly and operational performance of the present invention has been disclosed based on specific shapes and directions in the above description, those skilled in the art will appreciate that various modifications, additions and substitutions are possible, without departing from the scope and spirit of the invention as disclosed in the accompanying claims.

What is claimed is:

1. A shock absorbing shoe with improved assembly and operational performance, comprising: an outsole (10); an upper sole (20) having a guide portion (21); and a pair of support units disposed between the outsole (10) and the upper sole (20), wherein each of the support units includes: a first support body (30A) bonded to the outsole (10); and a second support body (30B) bonded to the upper sole (20) and having a first guide part (33) at a position corresponding to the guide portion (21); a first holding body (35) bonded to the first support body (30A), wherein the first holding body (35) includes a first annular rim (35*d*) formed along an edge thereof, a first seat depression (35*e*) formed by the first annular rim (35*d*), a first fitting protrusion (35*c*) formed at a center of the first seat depression (35*e*), and a through-hole (35*b*) formed at a center of the first fitting protrusion (35*c*); a second holding body (37) bonded to the second support body (30B), wherein the second holding body (37) includes a second annular rim (37*d*) formed along an edge thereof, a second seat depression (37*e*) formed by the second annular rim (37*d*), a second fitting protrusion (37*c*) formed at a center of the second seat depression (37*e*), a protruding spacer part (36) protruding from the second fitting protrusion (37*c*) toward the first fitting protrusion (35*c*), and a second guide part (37*a*) formed at a center of both the second fitting protrusion (37*c*) and the protruding spacer part (36); a single coil spring (41) disposed between the first holding body (35) and the second holding body (37), wherein one end of the single coil spring (41) is fitted into the first seat depression (35*e*), and the other end of the single coil spring (41) is fitted into the second seat depression (37*e*); and a flexible supporting member (50) passing through the first guide part (33), the second guide part (37*a*), the single coil spring (41) and the through-hole (35*b*), wherein a protruding spacer part (36) has a length configured in such a way that, when the protruding spacer part (36) contacts the first fitting protrusion (35*c*) during compression, full compression of the single coil spring (41) is inhibited, and a space remains between the first annular rim (35*d*) and the second annular rim (37*d*) to thereby prevent the single coil spring (41) from being damaged due to over-compression and allow bending of the flexible support member (50).

2. The shock absorbing shoe with improved assembly and operational performance as set forth in claim 1, wherein the first support body (30A) includes a first circular depressed seat (31) into which the first holding body (35) is received, and the second support body (30*b*) includes a second circular depressed seat (31) into which the second holding body (37) is received.

3. The shock absorbing shoe with improved assembly and operational performance as set forth in claim 1, wherein the first holding body (35) includes a seat groove (35*a*) formed in a lower surface thereof, the supporting member (51) includes an insert hole (55*a*) formed in a lower end thereof, and a locking pin (60) is inserted into the insert hole (55*a*).

* * * * *